US010033076B2

(12) United States Patent
Hansen et al.

(10) Patent No.: US 10,033,076 B2
(45) Date of Patent: Jul. 24, 2018

(54) STACKED FILTERS

(71) Applicant: RAYTHEON COMPANY, Waltham, MA (US)

(72) Inventors: Bradley O. Hansen, Vail, AZ (US); Michael R. Beylor, Vail, AZ (US); Kevin W. Patrick, Tucson, AZ (US); Jeremy Bart Baldwin, Sahuarita, AZ (US); Michael D. Gordon, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 265 days.

(21) Appl. No.: 14/990,428

(22) Filed: Jan. 7, 2016

(65) Prior Publication Data

US 2017/0200998 A1 Jul. 13, 2017

(51) Int. Cl.
*H01P 1/203* (2006.01)
*H01P 3/08* (2006.01)

(52) U.S. Cl.
CPC ..... *H01P 1/203* (2013.01); *H01P 1/20345* (2013.01); *H01P 1/20363* (2013.01); *H01P 3/088* (2013.01)

(58) Field of Classification Search
CPC .. H01P 1/203; H01P 1/20345; H01P 1/20363; H01P 3/08; H01P 3/081; H01P 3/088
USPC ..... 333/204, 205, 246, 247
See application file for complete search history.

(56) References Cited

U.S. PATENT DOCUMENTS

| | | | | |
|---|---|---|---|---|
| 4,266,206 | A | 5/1981 | Bedard et al. | |
| 5,525,942 | A | 6/1996 | Horii et al. | |
| 6,236,572 | B1 | 5/2001 | Teshome et al. | |
| 6,326,677 | B1 * | 12/2001 | Bloom ..... | H01C 1/144 257/421 |
| 6,791,403 | B1 | 9/2004 | Tayrani et al. | |

(Continued)

FOREIGN PATENT DOCUMENTS

EP 1 109 246 A1 6/2001

OTHER PUBLICATIONS

Hartley, "Controlling Radiated EMI Through PCB Stack-up", EE Times, Sep. 8, 2000 Retrieved from the Internet at: URL:http://www.eetimes.com/document.asp?doc id =1214998, (pp. 1-7).

(Continued)

*Primary Examiner* — Benny Lee
*Assistant Examiner* — Jorge Salazar, Jr.
(74) *Attorney, Agent, or Firm* — Lewis Roca Rothgerber Christie LLP

(57) ABSTRACT

A filter assembly in a multi-layer printed wiring board. One or more conductors is formed on an internal layer of a printed wiring board. Surrounding dielectric layers and ground layers form, together with the conductors of the internal layer, microstrip or stripline transmission lines and distributed element filters. The filter assembly may include a plurality of internal conductive layers, each sandwiched between dielectric layers and ground layers, and each internal layer may include a plurality of distributed element filters. Connections from each filter to the surface of the filter assembly are formed by vias, and connections from the surface of the filter assembly to a host board are formed by solder joints.

14 Claims, 6 Drawing Sheets

(56) References Cited

U.S. PATENT DOCUMENTS

| | | | | |
|---|---|---|---|---|
| 7,755,457 | B2 * | 7/2010 | Lee | H01P 3/085 333/204 |
| 2002/0039055 | A1 * | 4/2002 | Ota | H01P 1/20381 333/134 |
| 2005/0088258 | A1 | 4/2005 | Fischer | |
| 2007/0182512 | A1 | 8/2007 | Lee et al. | |
| 2015/0257254 | A1 * | 9/2015 | Suzuki | H01L 23/552 343/700 MS |

OTHER PUBLICATIONS

International Search Report from corresponding International Application No. PCT/US2016/060666, International Search Report dated Feb. 15, 2017 and dated Feb. 22, 2017 (5 pgs).
Written Opinion of the International Searching Authority from corresponding International Application No. PCT/US2016/060666, dated Feb. 22, 2017 (8 pgs).

* cited by examiner

STACKED FILTERS

GOVERNMENT LICENSE RIGHTS

This invention was made with Government support. The Government has certain rights in the invention.

BACKGROUND

1. Field

One or more aspects of embodiments according to the present invention relate to radio frequency (RF) filters, and more particularly to RF filters that are stacked for improved packaging.

2. Description of Related Art

Printed wiring boards for processing microwave and radio frequency signals (referred to herein collectively as RF signals), e.g., for defense or commercial applications, may include various active and passive RF elements, as well as elements for providing and controlling bias voltages or currents, and for processing intermediate frequency or baseband signals. The RF signal processing elements may include distributed element filters, formed as conductive patterns in a signal layer adjacent to one or two ground layers (and separated from the ground layer or layers by one or two dielectric layers).

The fabrication of a distributed element filters may require tight tolerances, which may increase the cost of fabrication. Further, it may be beneficial to package distributed element filters in a space-efficient manner, to reduce cost and to facilitate the production of a compact system. Thus, there is a need for a cost-effective and compact design for distributed element filters.

SUMMARY

Aspects of embodiments of the present disclosure are directed toward a filter assembly in a multi-layer printed wiring board. One or more conductors are formed on an internal layer of a printed wiring board. Surrounding dielectric layers and ground layers form the dielectric and ground layers that together with the conductors of the internal layer form distributed element filters. The filter assembly may include a plurality of internal conductive layers, each sandwiched between dielectric layers and ground layers, and each internal layer may include a plurality of distributed element filters. Connections to the surface of the filter assembly are formed by vias, and connections from the surface of the filter assembly to a host board are formed by solder joints.

According to an embodiment of the present invention there is provided a filter circuit, including: a first filter assembly, including a printed wiring board including: a first conductive layer including a ground plane; a first dielectric layer on the first conductive layer; a second conductive layer on the first dielectric layer; a second dielectric layer on the second conductive layer; and a third conductive layer on the second dielectric layer, the third conductive layer including a ground plane; the second conductive layer including: a first distributed element filter having an input and an output; and a second distributed element filter having an input and an output; the first conductive layer further including: a first input conductor and a first output conductor, the first input conductor and the first output conductor being connected by respective first and second signal vias through the first dielectric layer to the input and output of the first filter respectively, and a second input conductor and a second output conductor, the second input conductor and the second output conductor being connected by respective third and fourth signal vias through the first dielectric layer to the input and output of the second filter respectively, the ground plane of the first conductive layer having a first cutout for the first input conductor, a second cutout for the first output conductor, a third cutout for the second input conductor and a fourth cutout for the second output conductor.

In one embodiment, the filter includes: a plurality of ground vias connecting the first conductive layer and the third conductive layer.

In one embodiment, the filter includes: a third dielectric layer on the third conductive layer; a fourth conductive layer on the third dielectric layer, the fourth conductive layer including a ground plane; a fourth dielectric layer on the fourth conductive layer; a fifth conductive layer on the fourth dielectric layer; a fifth dielectric layer on the fifth conductive layer; and a sixth conductive layer on the fifth dielectric layer, the sixth conductive layer including a ground plane; the fifth conductive layer including a third distributed element filter having an input and an output.

In one embodiment, the first conductive layer further includes a third input conductor and a third output conductor, the third input conductor and the third output conductor being connected by respective fifth and sixth signal vias to the input and output of the third filter respectively, and wherein the ground plane of the first conductive layer further has a fifth cutout for the third input conductor, and a sixth cutout for the third output conductor.

In one embodiment, the second conductive layer, the third conductive layer, and the fourth conductive layer, have respective cutouts, in respective areas of ground conductors, forming respective clear areas for the fifth and sixth signal vias.

In one embodiment, the filter includes a plurality of ground vias connecting the ground plane of the third conductive layer and the ground plane of the fourth conductive layer, through the third dielectric layer.

In one embodiment, the filter includes a plurality of ground vias connecting the ground plane of the fourth conductive layer and the ground plane of the sixth conductive layer.

In one embodiment, the filter includes: a third dielectric layer on the third conductive layer; a fourth conductive layer on the third dielectric layer; a fourth dielectric layer on the fourth conductive layer; and a fifth conductive layer on the fourth dielectric layer, the fifth conductive layer including a ground plane; the fourth conductive layer including a third distributed element filter having an input and an output.

In one embodiment, the first conductive layer further includes a third input conductor and a third output conductor, the third input conductor and the third output conductor being connected by respective fifth and sixth signal vias to the input and output of the third filter respectively, and wherein the ground plane of the first conductive layer further has a fifth cutout for the third input conductor, and a sixth cutout for the third output conductor.

In one embodiment, the filter includes: a plurality of ground vias connecting the ground plane of the first conductive layer and the ground plane of the third conductive layer; and a plurality of ground vias connecting the ground plane of the third conductive layer and the ground plane of the fourth conductive layer.

In one embodiment, the filter includes a host board including a printed wiring board including: a first dielectric layer; and a first conductive layer on the first dielectric layer, the first conductive layer of the host board having an input signal trace, an output signal trace, and a ground patch, the input signal trace being connected to the first input conductor of the first conductive layer of the first filter assembly, and the output signal trace being connected to the first output conductor of the first conductive layer of the first filter assembly.

In one embodiment, the input signal trace is connected to the first input conductor of the first conductive layer of the first filter assembly by a first solder joint, and the output signal trace is connected to the first output conductor of the first conductive layer of the first filter assembly by a second solder joint.

In one embodiment, the host board further includes a solder dam on the input signal trace.

In one embodiment, the filter includes: a plurality of ground vias connecting the first conductive layer and the third conductive layer.

In one embodiment, the filter includes: a third dielectric layer on the third conductive layer; a fourth conductive layer on the third dielectric layer, the fourth conductive layer including a ground plane; a fourth dielectric layer on the fourth conductive layer; a fifth conductive layer on the fourth dielectric layer; a fifth dielectric layer on the fifth conductive layer; and a sixth conductive layer on the fifth dielectric layer, the sixth conductive layer including a ground plane; the fifth conductive layer including a third distributed element filter having an input and an output.

In one embodiment, the first conductive layer further includes a third input conductor and a third output conductor, the third input conductor and the third output conductor being connected by respective fifth and sixth signal vias to the input and output of the third filter respectively, and wherein the ground plane of the first conductive layer further has a fifth cutout for the third input conductor, and a sixth cutout for the third output conductor.

In one embodiment, the second conductive layer, the third conductive layer, and the fourth conductive layer, have respective cutouts, in respective areas of ground conductors, forming respective clear areas for the fifth and sixth signal vias.

In one embodiment, the filter includes a plurality of ground vias connecting the ground plane of the third conductive layer and the ground plane of the fourth conductive layer, through the third dielectric layer.

In one embodiment, the filter includes a plurality of ground vias connecting the ground plane of the fourth conductive layer and the ground plane of the sixth conductive layer.

In one embodiment, the filter includes: a third dielectric layer on the third conductive layer; a fourth conductive layer on the third dielectric layer; a fourth dielectric layer on the fourth conductive ground layer; and a fifth conductive layer on the fourth dielectric layer, the fifth conductive layer including a ground plane; the fourth conductive layer including a third distributed element filter having an input and an output.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of a system of stacked filters provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1B:
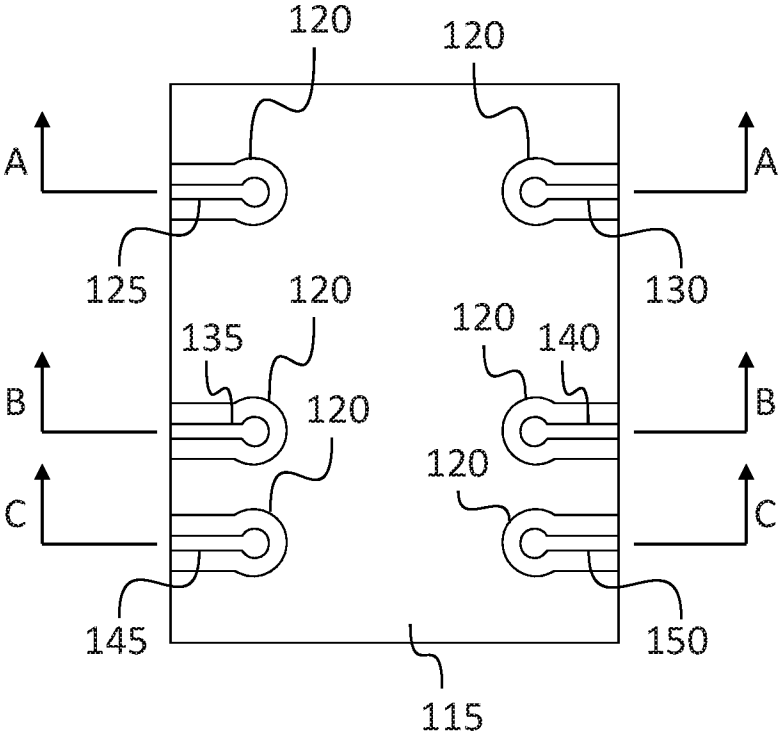
FIG. 1B is a bottom view of a filter assembly, according to an embodiment of the present invention.
Figure 1A:
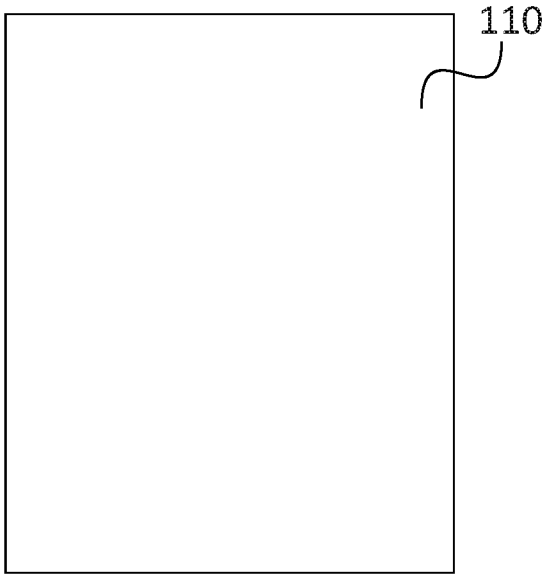
FIG. 1A is a top view of a filter assembly, according to an embodiment of the present invention.

Referring to the top view of FIG. 1A, in one embodiment a filter assembly is a multi-layer printed wiring board (PWB) having as its top layer (e.g., a sixth layer) 110 a conductive ground layer. Referring to the bottom view of FIG. 1B, the filter assembly may have a bottom layer (e.g., a first conductive layer) that includes a conductive ground plane 115 having a plurality of cutouts 120. The bottom layer may also include a plurality of signal conductors, each in a respective cutout 120 in the ground plane 115. The signal conductors may act as filter input and output connections. For example a first signal conductor 125 may act as an input connection to a first filter in the filter assembly, and a second signal conductor 130 may act as an output connection to the first filter. Similarly, second and third input connections 135, 145 and second and third output connections 140, 150 may act as input and output connections to second and third filters in the filter assembly, respectively.

Figure 1C:
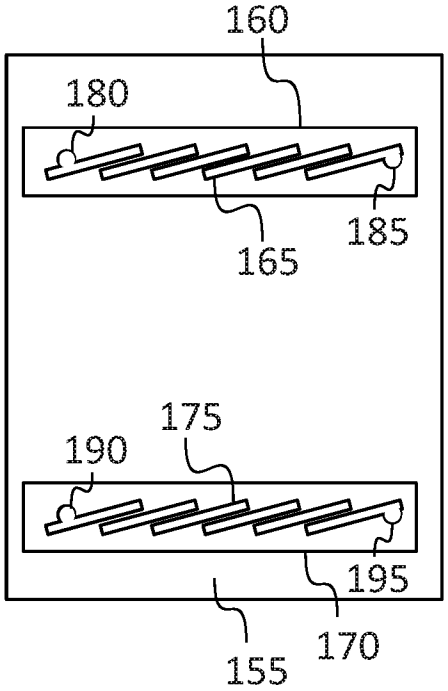
FIG. 1C is a top view of an internal conductive layer of a filter assembly, according to an embodiment of the present invention.

Referring to FIG. 1C, in one embodiment an intermediate conductive layer, e.g., a second conductive layer, includes a ground conductor 155 with a first cutout 160 for the first filter 165 and a second cutout 170 for the third filter 175. The filter circuits may include printed wiring distributed element filters such edge-coupled strips (as illustrated by way of example in FIG. 1C), e.g., edge-coupled half-wave strips, or other distributed elements fabricated as conductive areas formed in the second conductive layer. The first filter 165 has an input and an output that are connected to respective signal vias 180, 185 forming input and output connections to another conductive layer, e.g., to signal conductors 125, 130 (FIG. 1B) in the bottom layer of the filter assembly. Similarly, the third filter 175 has an input and an output that are connected to respective signal vias 190, 195 forming input and output connections to another conductive layer, e.g., to signal conductors 145, 150 (FIG. 1B) in the bottom layer of the filter assembly.

Printed conductors carrying an RF signal may be referred to herein as signal conductors or signal traces; these traces may be configured as stripline or microstrip transmission lines. As such, each such signal trace may be near a ground plane, e.g., separated from a ground plane by a dielectric layer, or separated from two ground planes, one above the signal trace and one below the signal trace, each separated from the signal trace by a dielectric layer.

Figure 2:
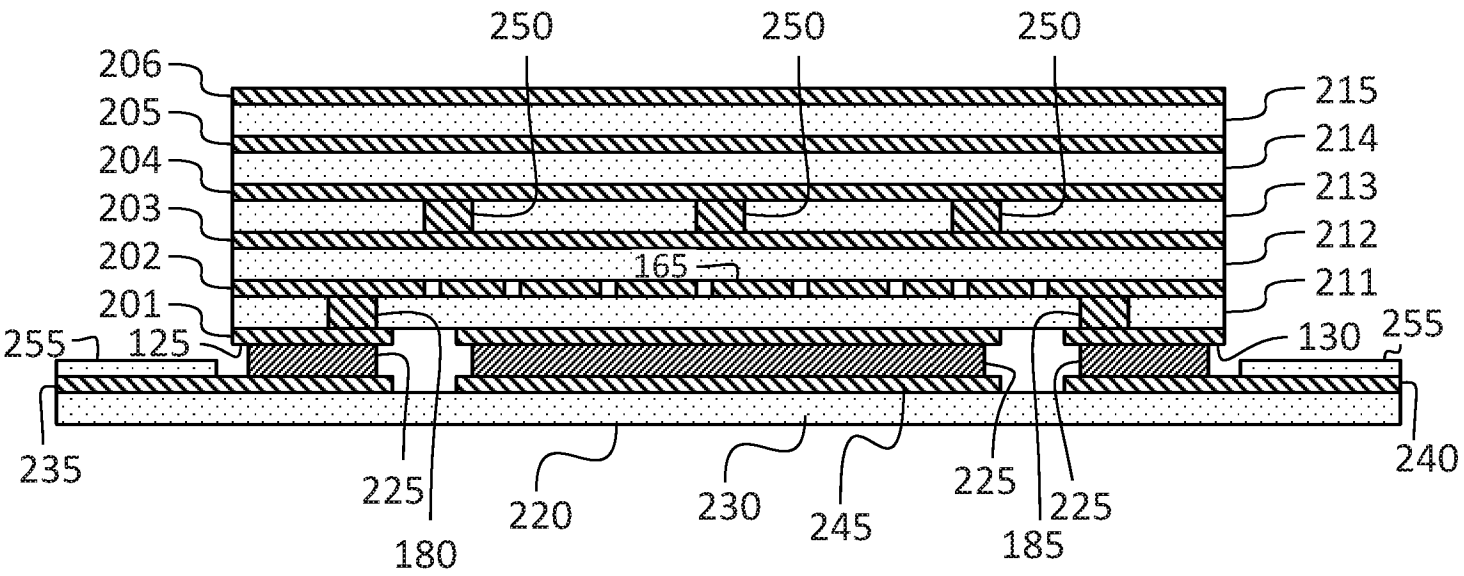
FIG. 2 is a cross-sectional view of a filter assembly taken along the line A-A of FIG. 1B, according to an embodiment of the present invention.

Referring to FIG. 2, in one embodiment, a filter assembly includes six conductive layers 201-206, separated by five dielectric layers 211-215. The filter assembly is secured to a host board 220 with solder joints 225. The host board is a PWB including a dielectric layer 230 and, on the dielectric layer 230, an upper conductive layer including an input signal trace 235, an output signal trace 240, and a ground patch 245. The input signal trace 235 and the output signal trace 240 are secured and connected, by respective solder joints 225, to the first signal conductor 125 and to the second signal conductor 130, respectively. Input via 180 connects the first signal conductor 125 to the input of the first filter 165, and output via 185 connects the second signal conductor 130 to the output of the first filter 165.

The dielectric layers may be composed of any dielectric suitable for use in a PWB and having acceptable properties within the frequency range for which the filters are designed. In some embodiments, high-frequency laminates available from Rogers Corporation (www.rogerscorp.com) are used.

Figure 4:
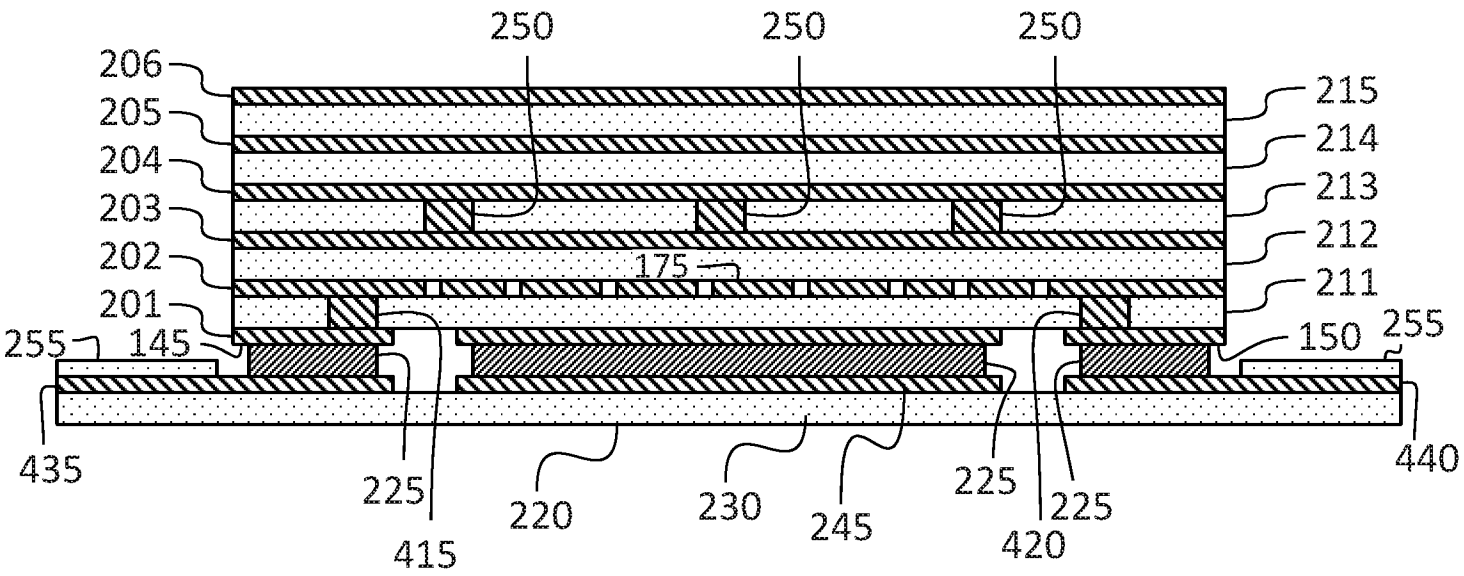
FIG. 4 is a cross-sectional view of a filter assembly taken along the line C-C of FIG. 1B, according to an embodiment of the present invention.

In the embodiment of FIG. 2, the first conductive layer 201 (i.e., the bottom layer) includes (as illustrated in FIG. 1B) a ground plane and cutouts for signal conductors, e.g., for the first signal conductor 125 and the second signal conductor. The second conductive layer 202 includes conductors forming the first filter 165, and may also include a surrounding ground patch, and conductors for additional filters, such as the third filter 175 (FIGS. 1C and 4). The third conductive layer 203 and the fourth conductive layer 204 may both be ground planes, and they may be connected together by ground vias.

The fifth conductive layer 205 may include conductors for the second filter (FIG. 3), discussed in further detail below, and the sixth conductive layer 206 may be a ground plane. The ground planes may be connected together by a plurality of ground vias 250. In FIG. 2, ground vias 250 are shown only connecting the third conductive layer 203 and the fourth conductive layer 204, but they may also connect other ground layers together and they may connect ground conductors in the signal layers to the ground layers. Ground continuity between the host board and the filter assembly may be provided by a solder joint 225 between a ground patch on the host board and a ground patch on the bottom layer 201 of the filter assembly.

Solder dams 255 may be formed on the input and output signal traces (e.g., on input signal trace 235, and on output signal trace 240) to prevent solder from flowing outward along the input or output signal trace, potentially leaving too little solder between the input or output signal trace and the corresponding conductor on the filter assembly (e.g., the first signal conductor 125 or the second signal conductor 130) to form a reliable solder joint. This solder dam may be a region of solder mask, for example, blocking the flow of liquid solder along the surface of the input or output signal trace.

Figure 3:
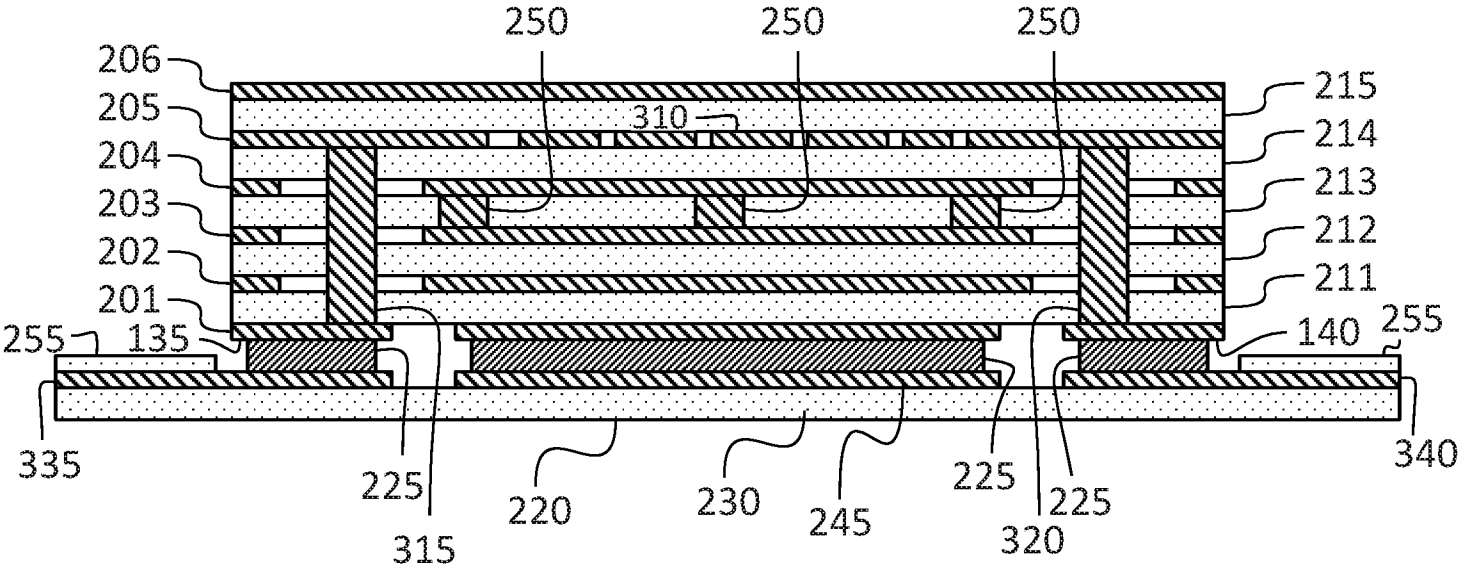
FIG. 3 is a cross-sectional view of a filter assembly taken along the line B-B of FIG. 1B, according to an embodiment of the present invention.

Referring to FIG. 3, in one embodiment the fifth conductive layer 205 includes conductors forming a second filter 310. A signal may propagate from the host board 220, through the second filter 310, and back to the host board 220 by propagating along an input signal trace 335, through a solder joint 225, through the second input connection 135 (also shown in FIG. 1B), through an input signal via 315, through the second filter 310, through an output signal via 320, through the second output connection 140, through another solder joint 225, and through an output signal trace 340.

Referring to FIG. 4, in one embodiment the second conductive layer 202 also includes conductors forming the third filter 175. A signal may propagate from the host board 220, through the third filter 175, and back to the host board 220 by propagating along an input signal trace 435, through a solder joint 225, through the third input connection 145 (also shown in FIG. 1B), through an input signal via 415, through the third filter 175, through an output signal via 420, through the third output connection 150, through another solder joint 225, and through an output signal trace 440.

Figure 5:
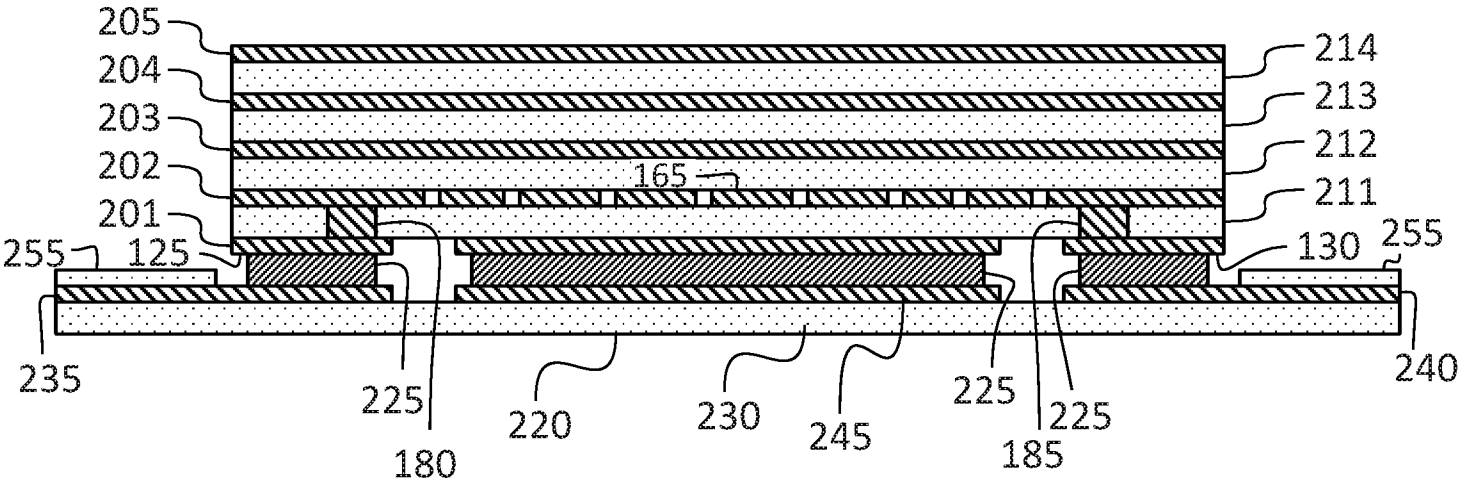
FIG. 5 is a cross-sectional view of a filter assembly, according to an embodiment of the present invention.

Referring to FIG. 5, one embodiment similar to that of FIGS. 2-4, differs from that of FIGS. 2-4 in that the third conductive layer 203 and the fourth conductive layer 204 of the embodiment of FIGS. 2-4 are replaced by a single conductive layer 203 in the embodiment of FIG. 5. This single conductor 203 serves as a ground plane for signal conductors (i.e., to form stripline transmission lines) in both the second conductive layer 202 of FIG. 5 and the fourth conductive layer 204 of FIG. 5.

As will be understood by those of skill in the art although an embodiment is described herein with five or six conductive layers, of which one layer includes two filters and another layer includes one filter, the invention is not limited thereto. For example, a filter assembly according to the present invention may include more or fewer than two conductive layers containing signal conductors forming filters and any of the filter layers may include one, two, or more filters.

It will be understood that although filter circuits are described herein as having an "input" and an "output", the invention is not limited to filter circuits intended, designed, or suitable for signal propagation in one direction, e.g., from input to output. In embodiments of the present invention, if a filter has two signal-carrying terminals, a first terminal and a second terminal, the first terminal may be referred to as the input and the second terminal may be referred to as the output, or the second terminal may be referred to as the input and the first terminal may be referred to as the output. Moreover, filters with more than two terminals (e.g., a duplexer or diplexer) are within the scope of the present invention.

The filter assembly may be fabricated by processes known to those of skill in the art for fabricating PWB assembly. Such processes may include, for example, forming conductive (e.g., copper) layers on dielectric sheets, masking and etching the conductive layers to form patterns in the conductive layers, drilling holes through the conductive layers and the dielectric sheets, plating the interior surfaces of the holes to form vias, and assembling multiple patterned layers to form a multi-layer PWB.

In one embodiment, the host board 220 includes a plurality of filter assemblies. The host board 220 is larger than the filter assemblies and is fabricated to looser tolerances than those used to fabricate the filter assemblies. The host board may be less costly to fabricate if looser tolerances are used than if tighter tolerances were used.

In one embodiment a plurality of filter assemblies is modular, i.e., various different filter assemblies contain filters with different characteristics, and they have the same interface to the host board 220 (e.g., the pattern of the bottom layer, as illustrated in FIG. 1B), so that the characteristics of the system including the host board may be changed by installing in any given filter assembly mounting location on the host board 220 a different filter assembly from the plurality of filter assemblies compatible with the mounting location.

In some embodiments the filter assemblies are installed on the host board by applying solder paste to the host board using a suitable stencil, placing one or more filter assemblies on the host board, and heating the host board with the filter assemblies (in a process that may be referred to as a "reflow" step), until the solder paste melts to form liquid solder. If the alignment of the filter assemblies as placed on the host board is imperfect, the liquid solder may have sufficiently high surface tension to pull the filter assemblies into alignment with the corresponding features on the host board.

Although limited embodiments of a system of stacked filters have been specifically described and illustrated herein, many modifications and variations will be apparent to those skilled in the art. Accordingly, it is to be understood that a system of stacked filters employed according to principles of this invention may be embodied other than as specifically described herein. The invention is also defined in the following claims, and equivalents thereof.

What is claimed is:

1. A filter circuit, comprising:

a first filter assembly, comprising a printed wiring board comprising:

a first conductive layer comprising a ground plane;

a first dielectric layer on the first conductive layer;

a second conductive layer on the first dielectric layer;

a second dielectric layer on the second conductive layer;

a third conductive layer on the second dielectric layer, the third conductive layer comprising a ground plane;

a third dielectric layer on the third conductive layer;

a fourth conductive layer on the third dielectric layer, the fourth conductive layer comprising a ground plane;

a fourth dielectric layer on the fourth conductive layer;

a fifth conductive layer on the fourth dielectric layer;

a fifth dielectric layer on the fifth conductive layer; and a sixth conductive layer on the fifth dielectric layer, the sixth conductive layer comprising a ground plane, the second conductive layer comprising:

a first distributed element filter having an input and an output; and a second distributed element filter having an input and an output;

the first conductive layer further comprising:

a first input conductor and a first output conductor, the first input conductor and the first output conductor being connected by respective first and second signal vias through the first dielectric layer to the input and output of the first distributed element filter respectively, and a second input conductor and a second output conductor, the second input conductor and the second output conductor being connected by respective third and fourth signal vias through the first dielectric layer to the input and output of the second distributed element filter respectively, the ground plane of the first conductive layer having a first cutout for the first input conductor, a second cutout for the first output conductor, a third cutout for the second input conductor and a fourth cutout for the second output conductor, and the fifth conductive layer comprising a third distributed element filter having an input and an output.

2. The filter circuit of claim 1, further comprising:

a plurality of ground vias connecting the first conductive layer and the third conductive layer.

3. The filter circuit of claim 1, further comprising a plurality of ground vias connecting the ground plane of the fourth conductive layer and the ground plane of the sixth conductive layer.

4. The filter circuit of claim 1, wherein the first conductive layer further comprises a third input conductor and a third output conductor, the third input conductor and the third output conductor being connected by respective fifth and sixth signal vias to the input and output of the third distributed element filter respectively, and wherein the ground plane of the first conductive layer further has a fifth cutout for the third input conductor, and a sixth cutout for the third output conductor.

5. The filter circuit of claim 4, wherein:

the second conductive layer, the third conductive layer, and the fourth conductive layer, have respective cutouts forming respective clear areas for the fifth and sixth signal vias.

6. The filter circuit of claim 1, further comprising a plurality of ground vias connecting the ground plane of the third conductive layer and the ground plane of the fourth conductive layer, through the third dielectric layer.

7. The filter circuit of claim 1, further comprising a host board comprising a printed wiring board comprising:

a first host dielectric layer; and a first host conductive layer on the first host dielectric layer, the first host conductive layer of the host board having an input signal trace, an output signal trace, and a ground patch, the input signal trace being connected to the first input conductor of the first conductive layer of the first filter assembly, and the output signal trace being connected to the first output conductor of the first conductive layer of the first filter assembly.

8. The filter circuit of claim 7, wherein the input signal trace is connected to the first input conductor of the first conductive layer of the first filter assembly by a first solder joint, and the output signal trace is connected to the first output conductor of the first conductive layer of the first filter assembly by a second solder joint.

9. The filter circuit of claim 8, wherein the host board further comprises a solder dam on the input signal trace.

10. The filter circuit of claim 9, further comprising:

a plurality of ground vias connecting the first conductive layer and the third conductive layer.

11. The filter circuit of claim 9, wherein the first conductive layer further comprises a third input conductor and a third output conductor, the third input conductor and the third output conductor being connected by respective fifth and sixth signal vias to the input and output of the third distributed element filter respectively, and wherein the ground plane of the first conductive layer further has a fifth cutout for the third input conductor, and a sixth cutout for the third output conductor.

12. The filter circuit of claim 11, wherein:

the second conductive layer, the third conductive layer, and the fourth conductive layer, have respective cutouts forming respective clear areas for the fifth and sixth signal vias.

13. The filter circuit of claim 9, further comprising a plurality of ground vias connecting the ground plane of the third conductive layer and the ground plane of the fourth conductive layer, through the third dielectric layer.

14. The filter circuit of claim 9, further comprising a plurality of ground vias connecting the ground plane of the fourth conductive layer and the ground plane of the sixth conductive layer.

* * * * *